US011952775B2

(12) United States Patent
Underkofler

(10) Patent No.: US 11,952,775 B2
(45) Date of Patent: Apr. 9, 2024

(54) CONNECTOR BRACKET FOR NON-RECTANGULAR GRID

(71) Applicant: USG Interiors, LLC, Chicago, IL (US)

(72) Inventor: Abraham M. Underkofler, Salem, WI (US)

(73) Assignee: USG INTERIORS, LLC, Chicago, IL (US)

( * ) Notice: Subject to any disclaimer, the term of this patent is extended or adjusted under 35 U.S.C. 154(b) by 98 days.

(21) Appl. No.: 17/815,628

(22) Filed: Jul. 28, 2022

(65) Prior Publication Data

US 2024/0035277 A1 Feb. 1, 2024

(51) Int. Cl.
*E04B 9/12* (2006.01)
*E04B 1/38* (2006.01)

(52) U.S. Cl.
CPC ..... *E04B 9/12* (2013.01); *E04B 1/388* (2023.08); *E04B 2001/389* (2023.08)

(58) Field of Classification Search
CPC ... E04B 9/12; E04B 9/08; E04B 1/388; E04B 2001/389
See application file for complete search history.

(56) References Cited

U.S. PATENT DOCUMENTS

| | | | | |
|---|---|---|---|---|
| 8,443,564 | B2 * | 5/2013 | Bankston, Jr. | E04B 9/127 52/712 |
| 10,676,925 | B2 * | 6/2020 | Baxter | E04B 9/003 |
| 11,280,089 | B2 * | 3/2022 | Harnish | E04B 9/064 |
| 11,525,261 | B2 * | 12/2022 | Neal | E04B 9/12 |
| 2012/0017531 | A1 | 1/2012 | Bankston | |
| 2019/0292780 | A1 * | 9/2019 | Baxter | E04B 9/12 |
| 2019/0292781 | A1 | 9/2019 | Neal | |
| 2019/0360203 | A1 * | 11/2019 | Harnish | E04B 9/345 |

OTHER PUBLICATIONS

International Search Report and Written Opinion of the International Searching Authority dated Nov. 21, 2023 of PCT/US2023/028362, filed Jul. 21, 2023.

* cited by examiner

*Primary Examiner* — Rodney Mintz
(74) *Attorney, Agent, or Firm* — Pearne & Gordon LLP

(57) ABSTRACT

The invention provides a bracket design for connecting cross and main tees of a suspended ceiling in non-rectangular joints to provide a wide variety of ceiling patterns including rhombic and triangular shapes.

7 Claims, 4 Drawing Sheets

FIG. 1
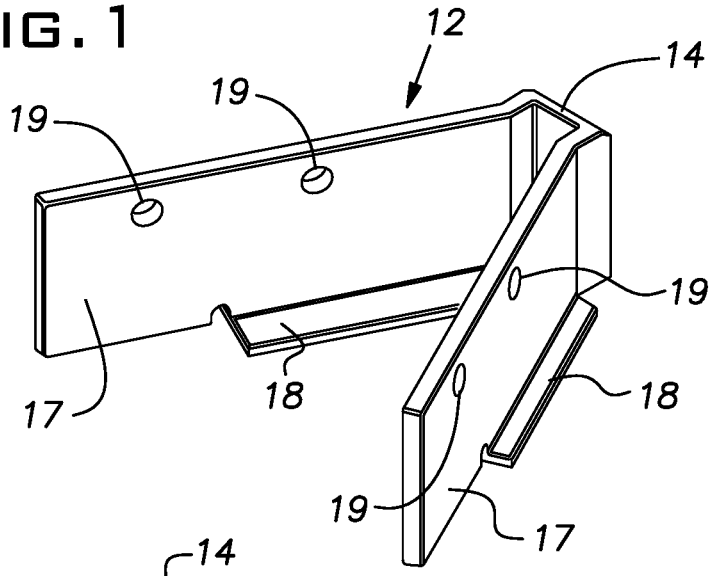
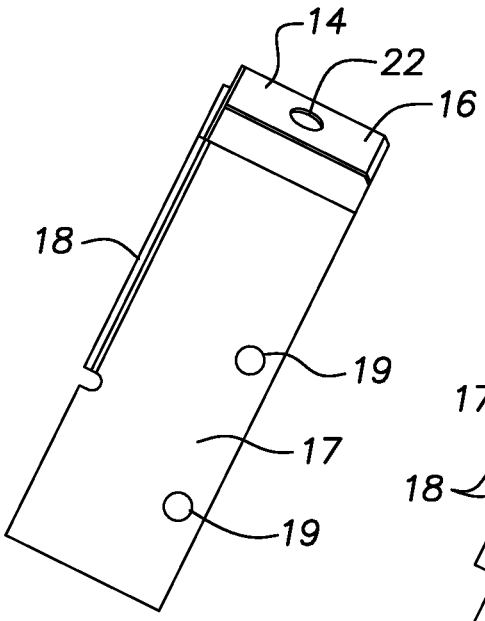
FIG. 3
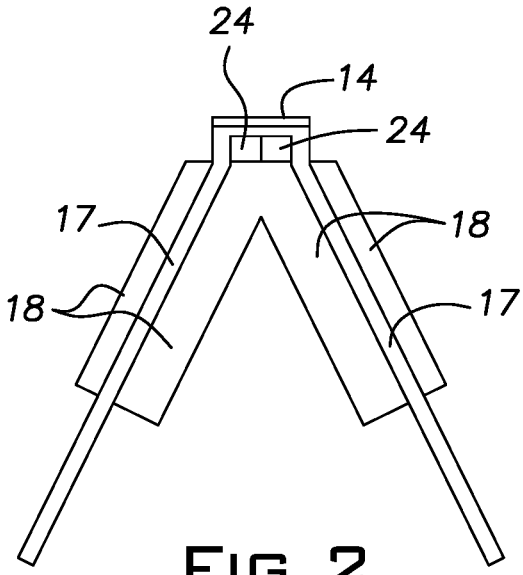
FIG. 2
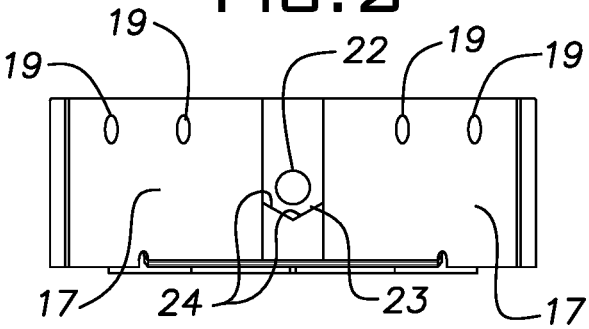
FIG. 4

CONNECTOR BRACKET FOR NON-RECTANGULAR GRID

BACKGROUND OF THE INVENTION

The invention relates to suspended ceiling construction and more specifically to such ceilings with a non-rectilinear grid and tile elements.

PRIOR ART

Suspended ceilings ordinarily have suspended grid elements arranged in rectangular patterns that border and support rectangular or square tiles or panels. Architects, interior designers, and occupants of a space can desire a suspended ceiling arrangement different from the ubiquitous rectangular patterns. U.S. Patent Publication No. US 2019/0292781 A1 discloses connectors and grid tees that form non-rectangular grid designs but can require relatively expensive tooling and lack performance in seismic applications.

SUMMARY OF THE INVENTION

The invention provides a bracket design for connecting cross and main tees of a suspended ceiling in non-rectangular joints to provide a wide variety of ceiling patterns including rhombic and triangular shapes.

BRIEF DESCRIPTION OF THE DRAWINGS

FIG. 1 is a perspective view of a full angle bracket embodying the invention;

FIG. 2 is top plan view of the full angle bracket;

FIG. 3 is a side view of the full angle bracket taken in a plane parallel to one of its legs;

FIG. 4 is an elevational view of a side of the full angle bracket that faces away from a main tee;

DESCRIPTION OF THE PREFERRED EMBODIMENTS

Figure 12:
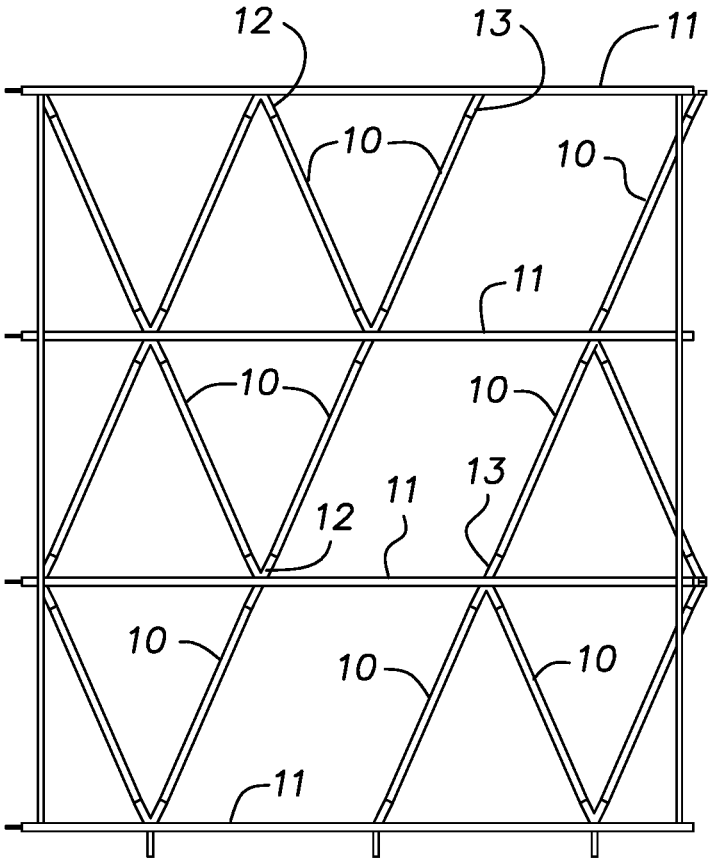
FIG. 12 is a diagrammatic showing of a representative grid pattern obtained by the invention.

Referring in general to the drawings and specifically to FIG. 12, custom length cross tees 10 are connected at their ends to main tees 11, the latter typically extending in lengths of 12 feet, with inventive brackets 12, 13. As shown, the cross tees intersect the main tees at selected angles of less than 90 degrees, e.g. inside angles of 53.13, 28.07 and 14.25 degrees, for example. The main tees 11 are parallel and spaced on 2 or 4 foot centers. Lengths of factory cut cross tees 10 depend on the main tee spacing and the angle at which a cross tee intersects the main tees 11.

Referring to FIGS. 1-4, a full angle bracket 12 has a generally V-shape when viewed from the top or bottom of its installed orientation. The bracket 12 includes a base 14 with a flat face 16 and divergent legs 17 which are mirror images of one another. In the illustrated case, the legs 17 diverge at an included angle of 53.13 degrees. Each leg 17 has an asymmetric horizontal flange 18 at a lower edge, being offset of the vertical plane of the respective leg towards a center line between the legs. Each leg 17 is provided with a pair of horizontally spaced through holes 19 adjacent an upper edge of the leg and remote from the flange 18. One hole 19 is outboard, relative to the base 14, of its respective flange 18. As shown in FIG. 4, the base 14 has a central through hole 22. The hole 22 communicates with a pocket 23 that includes a V-forming pair of shoulders 24.

Figure 8:
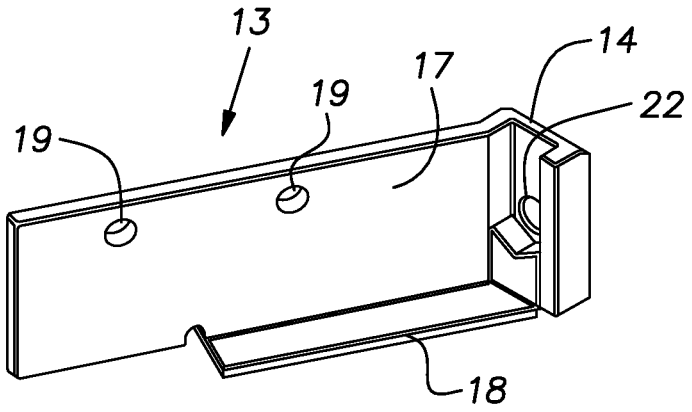
FIG. 8 is a perspective view of a left hand version of a bracket.
Figure 10:
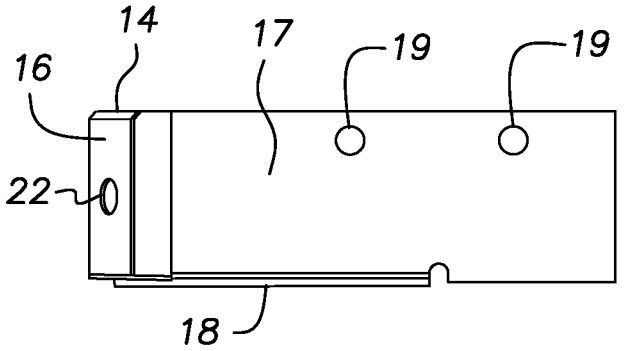
FIG. 10 is a side view of the left hand bracket.
Figure 9:
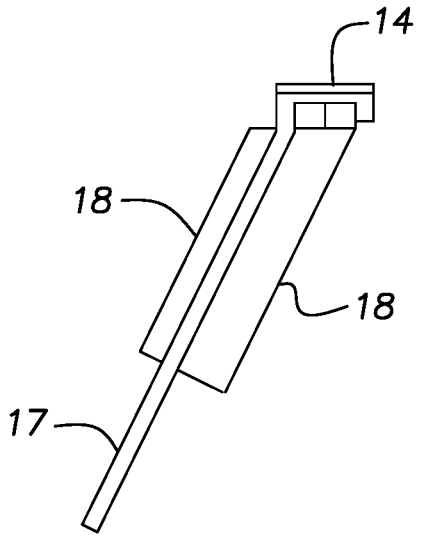
FIG. 9 is a plan view of the left hand bracket.

FIGS. 8-10 illustrate a left hand version of a bracket 13. A right hand version is a mirror image of the left hand version. Parts of the bracket 13 that are the same or equivalent in structure or function to that described of the full angle bracket 12 are designated with numerals that are increased by 100 from those used to describe the full angle bracket.

Figure 5:
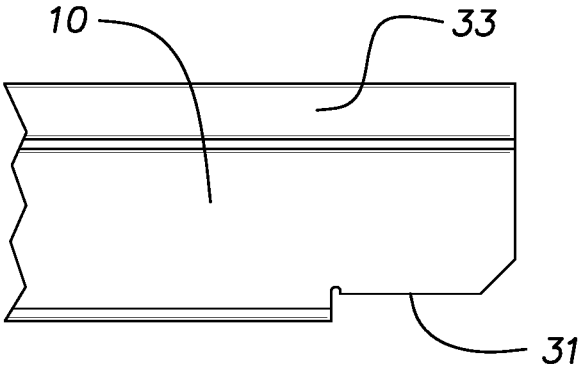
FIG. 5 is a side view of a cross tee end.
Figure 6:
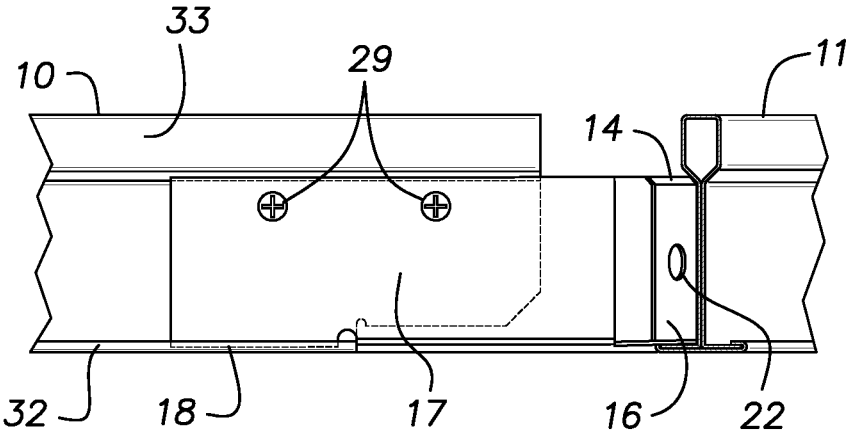
FIG. 6 is a view with a cross tee installed on a bracket leg.
Figure 7:
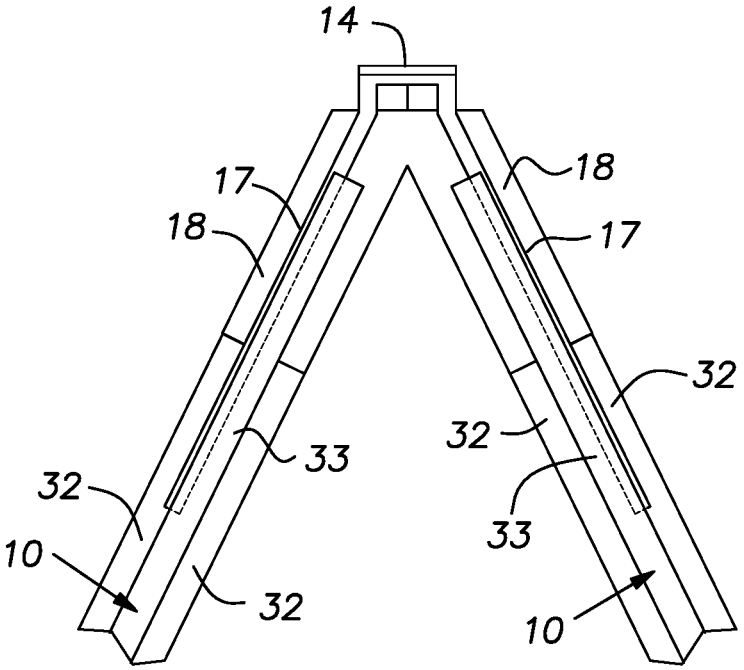
FIG. 7 is a plan view similar to FIG. 2 with cross tees installed on the bracket.
Figure 11:
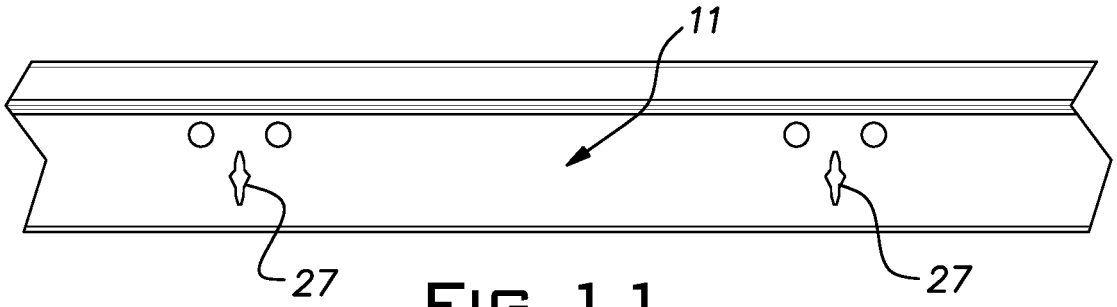
FIG. 11 is a side view of a segment of a main tee.

FIG. 11 shows cross tee slots 27 in a conventional main tee 11. Either of the brackets 12, 13 is installed at an appropriate one of regularly spaced slots 27 by assembling a No. 8 machine screw, for example, through the main runner slot 27 and bracket hole 22. A hex nut, threaded on a screw, is rotationally locked in the pocket 23 by the flats or shoulders 24 and surrounding walls of the brackets 12, 13. A cross tee end (FIG. 5) is cut along different planes to form a lower notch 31 having a height at least equal to the thickness of the bracket flanges 18. So called framing screws 29, that are self-tapping, are assembled in the bracket holes 19 and driven into the web of the cross tee 10. Each leg 17 is proportioned to fit snuggly, i.e. with no or minimal clearance in the vertical space between a cross tee flange 32 and a reinforcing bulb 33. When a bracket 12, 13 is installed on the main tee 11, the vertical surface of a bracket leg 17 and a web of the cross tee 10 fastened thereto are in vertical planes that substantially intersect the base hole 22 and respective main tee slot 27. The screws 29 and snug fit of the legs 17 produce a rigid assembly or structure that can provide seismic service. With a bracket 12, 13 installed on a main tee 11 and a leg cross tee 10 installed on the bracket, lower faces of the leg flanges 18 are substantially coplanar with a lower face of the main tee flange.

The brackets 12, 13 can be cast of a suitable metal or metal alloys. Besides casting, the brackets can be molded of a suitable plastic or 3D printed. Additionally, the brackets can be fabricated of sheet metal such as aluminum.

While the invention has been shown and described with respect to particular embodiments thereof, this is for the purpose of illustration rather than limitation, and other variations and modifications of the specific embodiments herein shown and described will be apparent to those skilled in the art all within the intended spirit and scope of the invention. Accordingly, the patent is not to be limited in scope and effect to the specific embodiments herein shown and described nor in any other way that is inconsistent with the extent to which the progress in the art has been advanced by the invention.

What is claimed is:

1. A system for attaching a cross runner to a main runner in a non-rectangular suspended ceiling grid, comprising:

a connector bracket of unitary, one-piece construction having a base with a completely flat face configured to abuttingly engage with a main tee web of the main runner in an installed configuration, a hole penetrating through said face configured to receive a screw through a cross tee aperture in the main tee web, the bracket having a leg angularly diverging from the base and defining an acute or obtuse angle with the main runner in the installed configuration, the leg having a vertical surface and an asymmetric horizontal flange horizontally spaced from the base a distance substantially equal to a distance defined by an edge of a flange of the main runner extending from the main tee web such that a lower edge of the horizontal flange is substantially coplanar with a lower face of the flange of the main runner in the installed configuration, the vertical surface being one piece with the base and extending beyond the asymmetric flange, a fastener receiving hole in the vertical surface configured to receive a fastener extending through the vertical surface and attaching a cross runner web to the bracket, the vertical surface and the web of the cross runner attached thereto lying in vertical planes substantially intersecting the hole in the base.

2. The system as set forth in claim 1, wherein the leg of the connector bracket is a first leg and further including an additional leg symmetrical with said first leg about a plane perpendicular to said base flat face.

3. The system as set forth in claim 1, wherein said vertical surface is proportioned to fit snuggly with substantially no clearance between a lower flange and an upper reinforcing bulb of the cross runner.

4. The system as set forth in claim 1, wherein the leg of the connector bracket further includes an additional fastener receiving hole in the vertical surface.

5. The system as set forth in claim 4, wherein said fastener receiving holes of said vertical surface are longitudinally spaced.

6. The system as set forth in claim 4, wherein said fastener receiving holes are adjacent a top edge of said vertical surface and remote from a lower edge of said vertical surface.

7. The system as set forth in claim 4, wherein one of said fastener receiving holes is longitudinally beyond said asymmetric flange from said base.

* * * * *